310-10 SR
FIP8502 XR 4,385,340

United States Patent [19]
Kuroshima

[11] 4,385,340
[45] May 24, 1983

[54] METHOD AND APPARATUS FOR GENERATING STATIC ELECTRICITY

[75] Inventor: Hiroshi Kuroshima, Owariasahi, Japan

[73] Assignee: Asahiokuma Sangyo Kabushiki Kaisha, Japan

[21] Appl. No.: 244,597

[22] Filed: Mar. 17, 1981

[30] Foreign Application Priority Data

May 2, 1980 [JP] Japan ..... 55-59814

[51] Int. Cl.[3] ..... B05B 5/02
[52] U.S. Cl. ..... 361/228; 361/227; 310/10; 310/308
[58] Field of Search ..... 361/225-228; 310/10, 308, 309

[56] References Cited

U.S. PATENT DOCUMENTS

| | | | |
|---|---|---|---|
| 3,273,015 | 9/1966 | Fischer | 361/227 |
| 3,612,923 | 10/1971 | Collier et al. | 310/10 |
| 3,895,262 | 7/1975 | Ribnitz | 361/227 |
| 3,949,410 | 4/1976 | Bassous et al. | 361/228 X |
| 4,033,506 | 7/1977 | Braun | 361/228 X |
| 4,073,002 | 2/1978 | Sickles et al. | 361/227 |

*Primary Examiner*—Donovan F. Duggan
*Attorney, Agent, or Firm*—Blair, Brown & Kreten

[57] ABSTRACT

A method and apparatus for creating electrostatic field by forming a high resistive anodic-oxidized film on an electrostatic electrode and applying thereto a high voltage direct current including high frequency component resonatable with inherent resistance and capacitance in the high resistive film.

5 Claims, 7 Drawing Figures

METHOD AND APPARATUS FOR GENERATING STATIC ELECTRICITY

BACKGROUND OF THE INVENTION

1. Field of the Invention

This invention relates to a method and apparatus for generating static electricity.

2. Description of the Prior Art

The electrode used in an apparatus which utilizes static electricity (for example, an electrostatic preciptator, an electrostatic coating apparatus, etc.) is usually of an exposed type. Consequently, there are problems associated with this type of electrode, such as a potential hazard, wear and corrosion of the electrode due to corona discharge, and so on.

The electrostatic electrode further has an ill effect in that the electrode can thereon accumulate electric charge as condensers do, and therefore it includes another difficulty that its surface area for electrostatic action is limited by the effect.

More particularly, any charge accumulated on an electrode may cause undesired discharge, even after high voltage applied to the electrode has been interrupted. In addition, the larger the surface area of the electrode, the stronger the discharge, since the amount of charge accumulated on an electrode is proportional to the surface area of the electrode.

For this reason, therefore, in an electrostatic coating apparatus for example, there has been a problem of accidental fire due to possible electric discharge toward the thinner or the like filling the job site.

SUMMARY OF THE INVENTION

An object of this invention is to provide a novel method and apparatus for generating static electricity, wherein an electrode used in the apparatus is extremely safe.

Another object of this invention is to provide a method and apparatus for generating static electricity, wherein corrosion resistivity of the electrode is extremely high.

A further object of this inventon is to provide a method and apparatus for generating static electricity, wherein the electrode is not subject to wear due to corona discharge.

Still another object of this invention is to provide a method and apparatus for generating static electricity which has a stronger electrostatic effect than conventionally achieved.

A still further object of this invention is to provide a method and apparatus for generating static electricity, whereby paint consumption may be economized, for example, in an electrostatic coating apparatus, and electric energy in an electrostatic preciptator or in a static electricity removing apparatus.

Other and further objects of this invention will become obvious upon an understanding of the illustrative embodiment about to be described or will be indicated in the appended claims, and various advantages not referred to herein will occur to one skilled in the art upon employment of the invention in practice.

DETAILED DESCRIPTION OF THE PREFERRED EMBODIMENT

Figure 1:
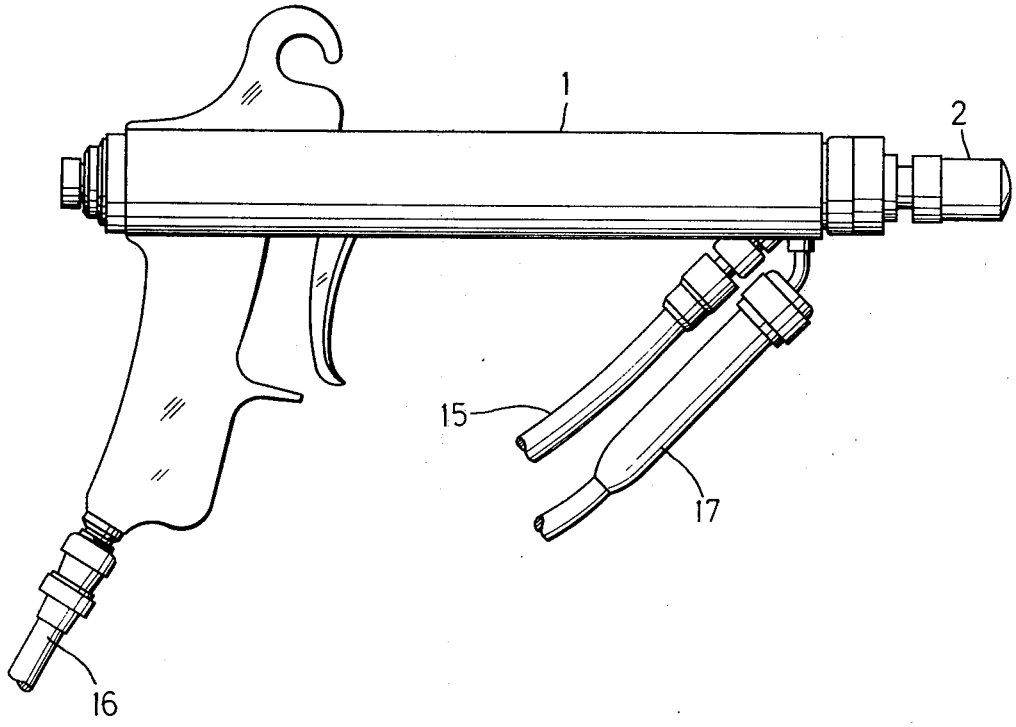
FIG. 1 is a side elevational view of a spray gun incorporating the present invention.

Referring to the drawings and to FIG. 1 in particular, reference numeral 1 indicates a spray gun including an electrode 2 for electrostatic coating arranged at one end of the gun. The electrode 2 comprises an electrode body 4 having an opening in the right-hand end in FIG. 2, a nozzle member 3 inserted in the body 4 for regulating the rate of paint flow, and a cap 5 encircling the body 4 for regulating the rate of air flow. According to the embodiment of this invention, each of the above-mentioned members is formed of aluminum or its alloys and is hard anodic-oxidized for insulation.

Figure 3:
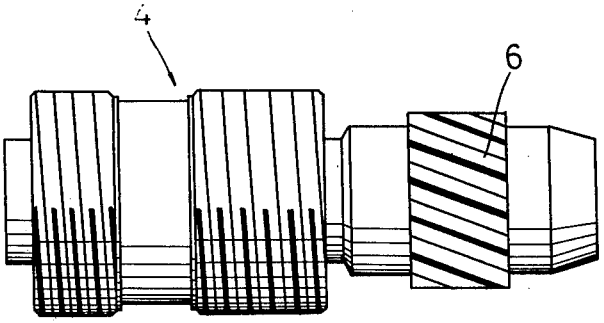
FIG. 3 is a side elevational view of the electrode body.
Figure 5:
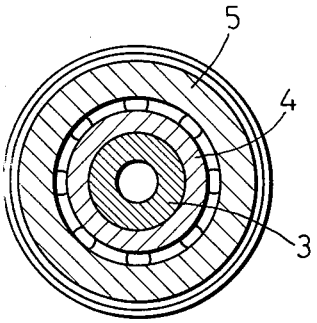
FIG. 5 is a sectional view taken substantially along the line V—V of FIG. 2.

At about the central portion of the inside of the body 4, there is provided a female thread **4*a* with which engages a male thread 3*b* of the nozzle member 3. A plurality of air passages 6 for jetting air is formed on the periphery of the body 4**, as most clearly seen in the right-hand direction of FIG. 3.

Figure 2:
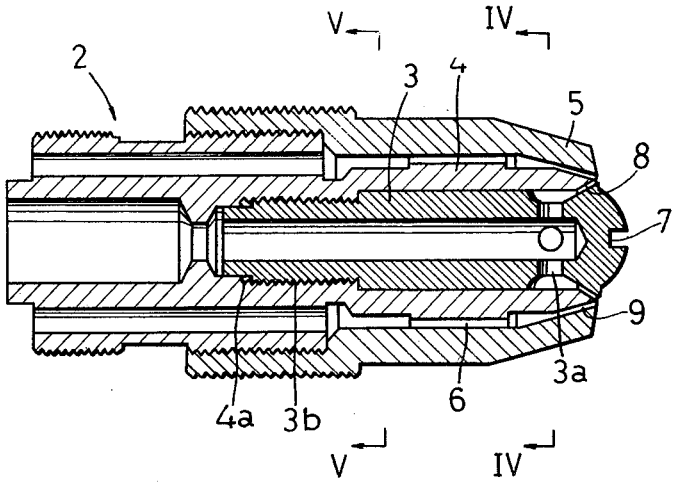
FIG. 2 is a sectional side elevational view of the electrode for electrostatic coating.
Figure 4:
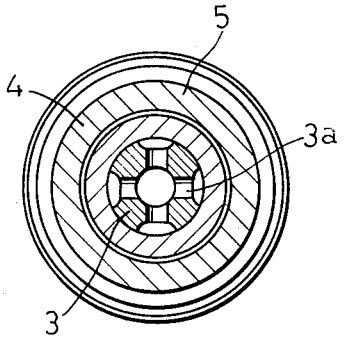
FIG. 4 is a sectional view taken substantially along the line IV—IV of FIG. 2.

The nozzle member 3 is formed in a cylindrical body having an opening in the left-hand end in FIG. 2 and closed at the right-hand end. The nozzle member 3 also includes at its right-hand end a plurality of, for example, four paint outlets **3*a* extending radially therethrough, as seen in FIG. 4. Since the female thread 3*b* engages with the male thread 4*a* of the body 4, as already discussed above, the rate of paint flow from the paint nozzle 8 may be controlled upon threaded movement of the nozzle member 3 by a screwdriver (not shown) applied at the latch slot 7 provided at the right-hand end of the nozzle member 8**.

A portion of the cap 5 is threadedly engaged with the body 4 and adapted to control air flow from the air nozzle 9 by threaded movement of the cap 5.

Figure 6:
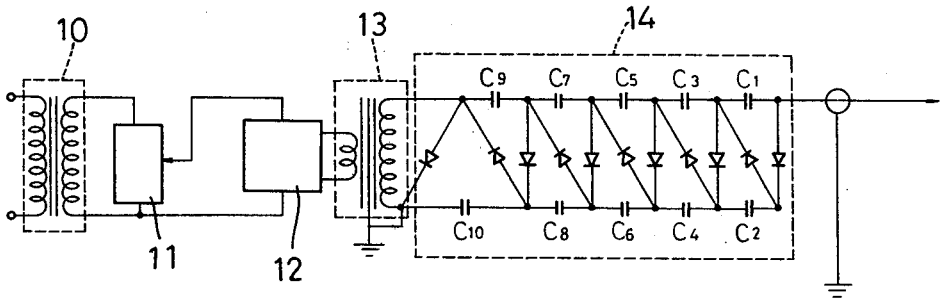
FIG. 6 is a schematic diagram of the electrical circuit of the power supply.

Referring now to FIG. 6, a power source for supplying high voltage to the electrostatic electrode is shown.

The power source includes an input transformer 10 and a voltage controller 11 for controlling the voltage to an oscillator 12. The voltage controller 11 allows the oscillator 12 to vary its frequency.

Reference numeral 13 is a booster transformer which serves to boost the high-frequency voltage produced from the oscillator 12 to a desired voltage.

Numeral 14 is a Cockcroft multi-stage booster which permits a multi-stage boosting of the high-frequency voltage fed by the booster transformer 13, and which converts the boosted voltage into a high-voltage direct current including high-frequency ripple.

Turning to FIG. 1, there are further shown a high tension cable 15, a paint hose 16, and an air hose 17.

Figure 7:
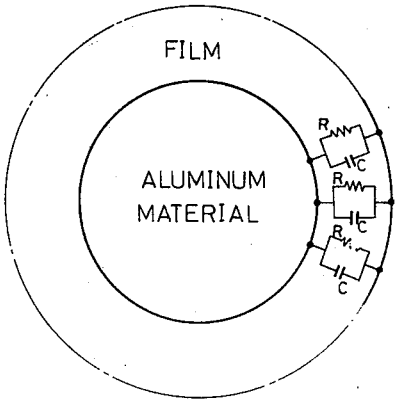
FIG. 7 is a schematic view illustrating an aspect of the arrangement of resistance R and capacitance C in the high-resistive film coated on the aluminum material.

Referring to FIG. 7, there is shown an aspect of resistance R and capacitance C carried by the high-resistive film coated on the surface of each member forming the afore-mentioned electrode 2.

A pair of resistance R and capacitance C shown in FIG. 7 represents a simulative sketch illustrated in view of the microscopic portion of the film, and it will be understood that the summation of the pairs may lead to the whole R and C included in the electrode. According to the embodiment of this invention, R and C serve as a parallel resonance circuit to resonate with the ripple component of the high-voltage direct current as well as to increase the crest of the ripple component, thereby assuring an increased electrostatic efficiency.

In operation, the voltage supplied from the commercial power source is controlled by the voltage controller 11 and is fed to the oscillator 12, which in turn produces a desired high frequency. The high frequency is then boosted by the booster transformer 13, followed by the Cockcroft multi-stage booster to thereby be converted into high-voltage direct current including the high-frequency ripple.

When the high-voltage direct current including high-frequency ripple is fed to the electrode 2 attached to the spray gun 1 through a high-tension cable 15, the aforementioned ripple resonates with resistance R and capacitance C to be formed into a peak-like wave form having higher crest, thereby assuring more efficient electrostatic action.

From the foregoing, it will be appreciated that a unique system has been devised for electrostatic coating operation which exhibits economy of paint consumption by its strong electrostatic action, and prevents wear and corrosion in electrode due to corona discharge.

A resistance of 100 megaohm is conferred to the film of the device, and, for safety reason, another resistance of 200 megaohm is inserted between the high-voltage source and electrode. Thus, when the spray gun is operated on 60,000 V, the possible current running through a human body, due to any electric shock, is about 200 microampere ±10%. This value is extremely on the safe side as particularly compared with 50 mili-ampere which is deemed fatal to a human body.

It should be noted that the apparatus according to the invention is specifically designed for protection against an electric shock resulting from the charge accumulated on the electrode itself which may not be prevented by only inserting a resistance between the electrode and high-voltage source. Thus, the charge accumulated on the electrode may not bring about a discharge at a dash, being blocked by the high resistance of 100 megaohm carried by the film.

This effect results from the repeated sudden change in electric field due to the high-frequency component contained in high-voltage direct current.

The following are the results of comparison between embodiments according to this invention and conventional art in terms of rate of paint deposition applied to electrostatic coating operation:

(1) when only high-voltage direct current was applied to the electrode, the rate of paint deposition was 85%.

(2) when high-voltage direct current overlaid with high frequency was applied, the rate of paint deposition was 90%.

(3) when the resonance action of film R-C component was utilized, the rate of paint deposition was 95%.

The above results were obtained based on the comparison of the green melamin resin amount coated on an aluminum foil using a spray gun boosted to 60,000 V and placed at 25 cm distance from the objective foil.

What is claimed is:

1. An apparatus for generating static electricity in paint or the like comprising in combination an electrostatic electrode coated with a hard anodic-oxidized film and a high-voltage direct current generator adapted to apply high voltage direct current to said electrode, said high-voltage direct current including a high frequency means to resonate with resistance and capacitance means carried in said film wherein said high frequency means comprises an oscillator fed by a voltage controller fed in turn by an input transformer whereby an increased electrical charge is applied to the paint, thereby enhancing electrostatic coating efficiency.

2. The apparatus of claim 1 wherein said high frequency means is boosted by being fed to a booster transformer.

3. The apparatus of claim 1 or 2 including a multi-stage booster fed by said booster transformer and directed to said electrode thereby forming a high-voltage direct current including a high-frequency ripple.

4. The apparatus of claim 1 or 2 wherein said resistance means includes a further resistance disposed between said high-voltage direct current and said electrode for shock amperage control.

5. An apparatus for generating static electricity in paint or the like comprising in combination an electrostatic electrode formed of an aluminum or an aluminum type of alloy and coated with a hard anodic-oxidized, high-resistive film; an oscillator circuit fed by a voltage controller for varying the frequency of said oscillator circuit, said frequency including a high frequency component to resonate with inherent resistance and capacitance carried in said film; a booster transformer for boosting the output voltage fed by said oscillator circuit; and a Cockcroft circuit for multi-stage boosting said output voltage boosted by said booster transformer whereby an increased electrical charge is applied to the paint, thereby enhancing electrostatic coating efficiency.

* * * * *